US008327560B2

(12) United States Patent
Berend

(10) Patent No.: US 8,327,560 B2
(45) Date of Patent: Dec. 11, 2012

(54) FOOTWEAR WITH SUPPORT PLATE ASSEMBLY

(75) Inventor: Thomas Berend, Beaverton, OR (US)

(73) Assignee: NIKE Inc., Beaverton, OR (US)

( * ) Notice: Subject to any disclaimer, the term of this patent is extended or adjusted under 35 U.S.C. 154(b) by 1009 days.

(21) Appl. No.: 12/104,003

(22) Filed: Apr. 16, 2008

(65) Prior Publication Data

US 2009/0260259 A1 Oct. 22, 2009

(51) Int. Cl.
*A43B 5/00* (2006.01)
*A43B 23/00* (2006.01)
*A43B 13/18* (2006.01)

(52) U.S. Cl. ..... 36/92; 36/132; 36/68; 36/69; 36/14

(58) Field of Classification Search ..... 36/25 R, 36/27–29, 38, 35 R, 35 B, 114, 7.8, 92, 68, 36/69, 132, 136, 89, 90, 129
See application file for complete search history.

(56) References Cited

U.S. PATENT DOCUMENTS

| | | | | |
|---|---|---|---|---|
| 3,586,003 | A * | 6/1971 | Baker | 36/145 |
| 4,402,146 | A * | 9/1983 | Parracho et al. | 36/129 |
| 4,484,397 | A | 11/1984 | Curley, Jr. | |
| 4,766,679 | A * | 8/1988 | Bender | 36/30 R |
| 4,866,861 | A | 9/1989 | Noone | |
| 4,947,560 | A * | 8/1990 | Fuerst et al. | 36/88 |
| 5,046,267 | A | 9/1991 | Kilgore et al. | |
| 5,060,401 | A | 10/1991 | Whatley | |
| 5,218,773 | A * | 6/1993 | Beekman | 36/68 |
| 5,247,742 | A | 9/1993 | Kilgore et al. | |
| 5,279,051 | A | 1/1994 | Whatley | |
| 5,297,349 | A | 3/1994 | Kilgore | |
| 5,313,717 | A | 5/1994 | Allen et al. | |
| 5,542,196 | A * | 8/1996 | Kantro | 36/44 |
| 5,845,420 | A | 12/1998 | Buccianti et al. | |
| 5,852,887 | A | 12/1998 | Healy et al. | |
| 5,896,683 | A | 4/1999 | Foxen et al. | |
| 6,055,746 | A * | 5/2000 | Lyden et al. | 36/29 |
| 6,108,943 | A | 8/2000 | Hudson et al. | |
| 6,321,469 | B1 * | 11/2001 | Cretinon | 36/102 |
| 6,401,366 | B2 | 6/2002 | Foxen et al. | |
| 6,438,873 | B1 * | 8/2002 | Gebhard et al. | 36/114 |
| 6,497,058 | B2 * | 12/2002 | Dietrich et al. | 36/69 |
| 6,871,421 | B2 | 3/2005 | Potter et al. | |
| 7,010,869 | B1 | 3/2006 | Ellis, III | |
| 7,082,702 | B2 * | 8/2006 | Cretinon | 36/88 |
| 7,299,567 | B2 * | 11/2007 | Berend et al. | 36/88 |
| 2005/0278980 | A1 | 12/2005 | Berend et al. | |
| 2006/0277798 | A1 | 12/2006 | Reilly et al. | |

FOREIGN PATENT DOCUMENTS

EP 1428447 A1 6/2004

OTHER PUBLICATIONS

International Search Report and Written Opinion mailed Jan. 20, 2010 in corresponding PCT Application No. PCT/US2009/039875.

* cited by examiner

*Primary Examiner* — Jila M Mohandesi
(74) *Attorney, Agent, or Firm* — Banner & Witcoff, Ltd.

(57) ABSTRACT

An article of footwear includes an upper and a midsole secured to the upper. A support plate assembly includes a support member extending along a portion of the upper. A plate extends inwardly from the support member, the plate being positioned between the outsole and the midsole. A groove is formed in an exterior surface of the support member, and is positioned outwardly of the plate and extends longitudinally along the exterior surface of the support member.

17 Claims, 4 Drawing Sheets

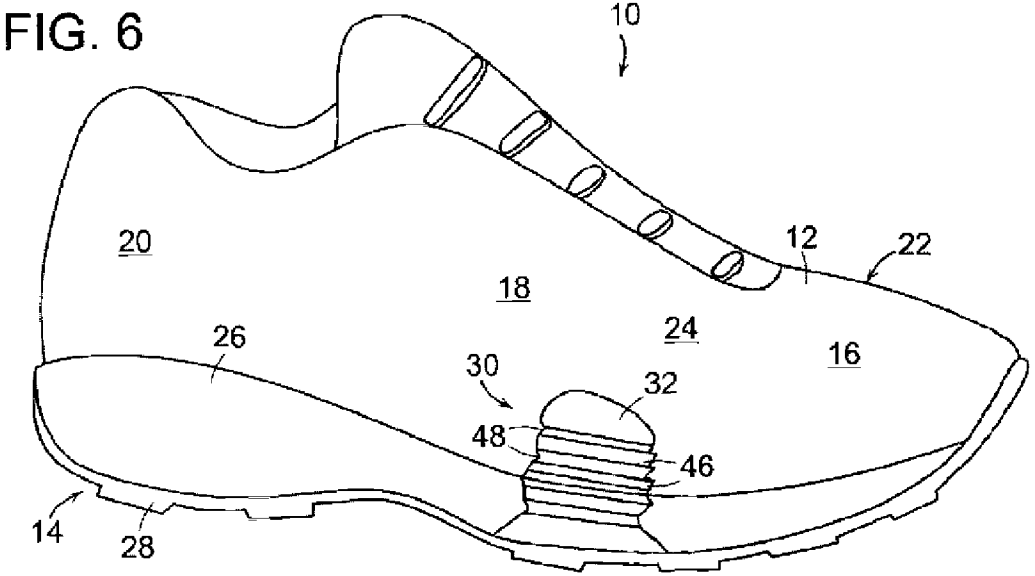
FIG. 6
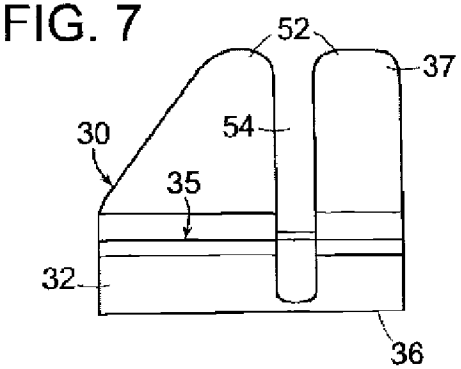
FIG. 7
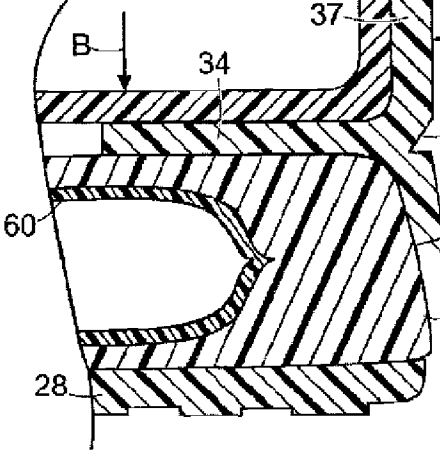
FIG. 8
FIG. 9

FOOTWEAR WITH SUPPORT PLATE ASSEMBLY

FIELD OF THE INVENTION

This invention relates generally to an article of footwear, and, in particular, to an article of footwear with a support plate assembly that provides improved stability.

BACKGROUND OF THE INVENTION

During certain athletic activities, such as tennis and basketball, for example, a user's footwear can undergo great strain while moving laterally. Known athletic footwear have incorporated different elements to help support the user's foot during such cutting motion. For example, a shank plate has been provided in the medial arch region, and fingers or pillars have been provided on the lateral side. These components are designed to provide support and leverage. During running, which is a linear activity, the foot undergoes forces tending to create pronation (inward movement of the foot) and supination (outward movement of the foot). Footwear may also include elements to help control pronation and supination.

It is an object of the present invention to provide an article of footwear with a support plate that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a support plate assembly. In accordance with a first aspect, an article of footwear includes an upper and a midsole secured to the upper. A support plate assembly includes a support member extending along a portion of the upper. A plate extends inwardly from the support member, the plate being positioned between the outsole and the midsole. A groove is formed in an exterior surface of the support member, and is positioned outwardly of the plate and extends longitudinally along the exterior surface of the support member.

In accordance with another aspect, an article of footwear includes an upper and a midsole secured to the upper. An outsole is secured to the midsole. A support plate assembly includes a support member extending along a portion of the upper and the midsole. A plate extends inwardly from the support member, with the plate being positioned between the outsole and the midsole. A lower plate extends inwardly from the support member, with the lower plate being positioned between the midsole and the outsole. A groove is formed in an exterior surface of the support member, and is positioned outwardly of the plate and extends longitudinally along the exterior surface of the support member.

Substantial advantage is achieved by providing footwear with a support plate assembly. In particular, certain embodiments provide support and leverage for a user during lateral movements.

These and additional features and advantages disclosed here will be further understood from the following detailed disclosure of certain embodiments.

BRIEF DESCRIPTION OF THE DRAWINGS

FIG. 6 is a perspective view of yet a further alternative embodiment of an article of footwear with a support plate assembly.

FIG. 7 is an elevation view of an alternative embodiment of a support plate assembly.

FIG. 8 is a section view of the support plate assembly of FIG. 7, shown secured to an article of footwear.

FIG. 9 is a section view of an alternative embodiment of an article of footwear, with a midsole including a fluid-filled bladder.

Figure 1:
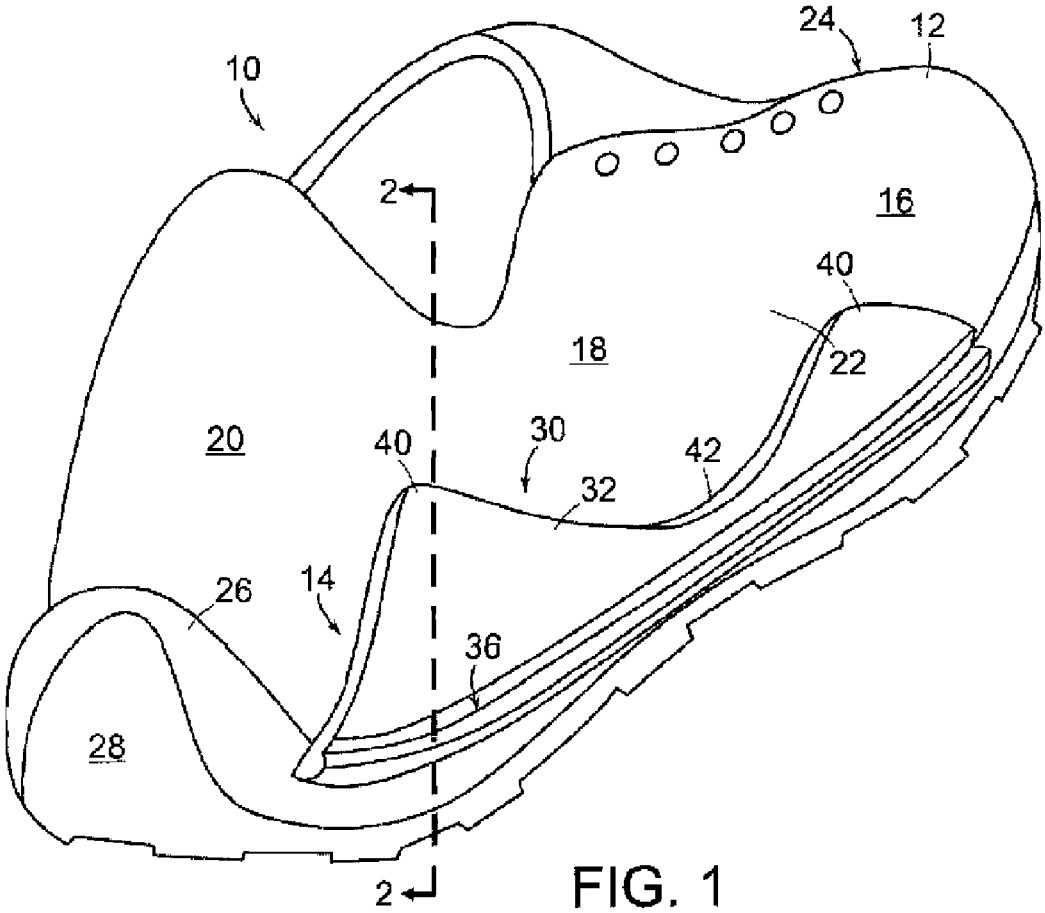
FIG. 1 is a perspective view of an article of footwear with a support plate assembly.

The figures referred to above are not drawn necessarily to scale, should be understood to provide a representation of particular embodiments of the invention, and are merely conceptual in nature and illustrative of the principles involved. Some features of the footwear with a support plate depicted in the drawings have been enlarged or distorted relative to others to facilitate explanation and understanding. The same reference numbers are used in the drawings for similar or identical components and features shown in various alternative embodiments. Footwear with a support plate as disclosed herein would have configurations and components determined, in part, by the intended application and environment in which they are used.

DETAILED DESCRIPTION OF CERTAIN PREFERRED EMBODIMENTS

The following discussion and accompanying figures disclose an article of footwear 10 in accordance with aspects of the present invention. Footwear 10 is depicted in the figures and discussed below as having a configuration that is suitable for athletic activities, particularly running. The concepts disclosed with respect to footwear 10 may, however, be applied to footwear styles that are specifically designed for a wide range of other athletic activities, including basketball, baseball, football, soccer, walking, and hiking, for example, and may also be applied to various non-athletic footwear styles, including dress shoes, loafers, sandals, and work boots. Accordingly, one skilled in the relevant art will recognize that the concepts disclosed herein may be applied to a wide range of footwear styles and are not limited to the specific embodiments discussed below and depicted in the figures.

Footwear 10 is depicted in FIG. 1 and includes an upper 12 and a sole assembly 14. For purposes of reference, footwear 10 may be divided into three general regions: a forefoot region 16, a midfoot region 18, and a heel region 20, as defined in FIG. 1. Forefoot region 16 generally includes portions of footwear 10 corresponding with the toes and the joints connecting the metatarsals with the phalanges. Midfoot region 18 generally includes portions of footwear 10 corresponding with the arch area of the foot, and heel region 20 corresponds with rear portions of the foot, including the calcaneus bone. Footwear 10 also includes a medial side 22 and an opposite lateral side 24. Medial side 22 and lateral side 24 extend through each of regions 16-20 and correspond with opposite sides of footwear 10.

Regions 16-20 and sides 22-24 are not intended to demarcate precise areas of footwear 10. Rather, regions 16-20 and sides 22-24 are intended to represent general areas of footwear 10 that provide a frame of reference during the following discussion. Although regions 16-20 and sides 22-24 apply generally to footwear 10, references to regions 16-20 and sides 22-24 may also apply specifically to upper 12, sole assembly 14, or an individual component or portion within either of upper 12 or sole assembly 14, or any other component of footwear 10.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 26, and an outsole 28.

Upper 12 forms an interior void that comfortably receives a foot and secures the position of the foot relative to sole assembly 14. The configuration of upper 12, as depicted, is suitable for use during athletic activities, e.g., running. Accordingly, upper 12 may have a lightweight, breathable construction that includes multiple layers of leather, textile, polymer, and foam elements adhesively bonded and stitched together. For example, upper 12 may have an exterior that includes leather elements and textile elements for resisting abrasion and providing breathability, respectively. The interior of upper 12 may have foam elements for enhancing the comfort of footwear 10, and the interior surface may include a moisture-wicking textile for removing excess moisture from the area immediately surrounding the foot.

Midsole 26 is attached to upper 12 and functions as the primary shock-attenuating and energy-absorbing component of footwear 10. Midsole 26 may be secured to upper 12 by adhesive or other suitable means. Outsole 28 is attached to the lower surface of midsole 26 by adhesive or other suitable means. Suitable materials for outsole 28 include traditional rubber materials. Other suitable materials for outsole 28 will become readily apparent to those skilled in the art, given the benefit of this disclosure. In certain embodiments, sole assembly 14 may not include an outsole layer separate from midsole 26 but, rather, the outsole may comprise a bottom surface of midsole 28 that provides the external traction surface of sole assembly 14.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1. Inwardly is toward the center of footwear 10, and outwardly is toward the outer peripheral edge of footwear 10.

Figure 2:
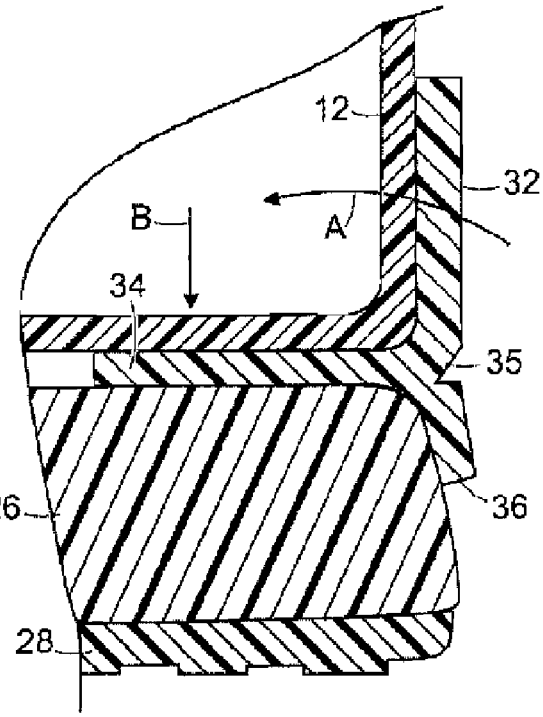
FIG. 2 is a section view of the article of footwear of FIG. 1, taken along line 2-2.

As seen in FIGS. 1-2, a support plate assembly 30 includes a support member 32 that extends along a portion of upper 12. A plate 34 extends inwardly from support member 32, and is positioned between midsole 26 and upper 12.

A notch, recess, or groove, 35 is formed on support member 32, outwardly of plate 34, and runs longitudinally along the exterior surface of support member 32. Groove 35 serves to act as a hinge point for support member 32, helping to allow an upper portion 37 of support plate 32, that is, the portion above groove 35, to flex inwardly in the direction of arrow A whenever a downward force (seen as arrow B) is created by impact from a user's foot, such as during running.

As the user's foot imparts a downward force in the direction of arrow B on plate 34 during running, support member 32 rotates inwardly toward a center of the footwear, providing support along the side (lateral or medial) side of the user's foot. Thus, support plate assembly 30 acts as a lever pivoting about a fulcrum to provide support for the user's foot. This pivoting action about a hinge point, or axis of rotation, will help to prevent pronation when support plate assembly 30 is positioned on the medial side 22 of footwear 10, and will help to prevent supination when support plate assembly 30 is positioned on lateral side 24 of footwear 10.

Figure 3:
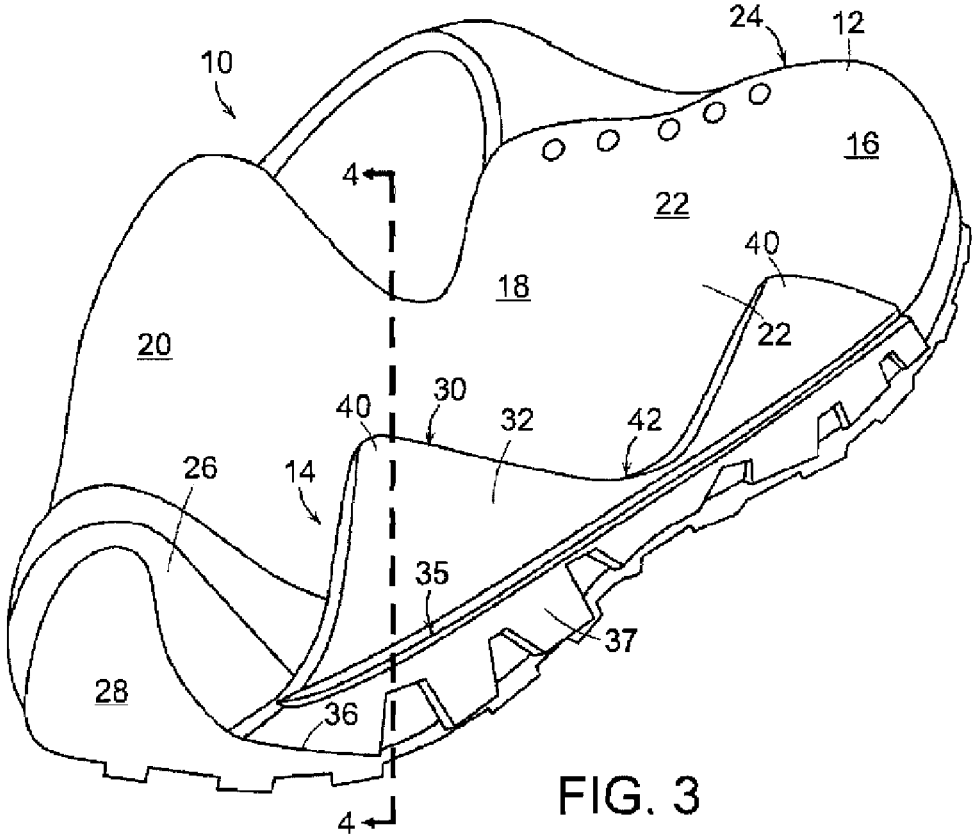
FIG. 3 is a perspective view of an alternative embodiment of an article of footwear with a support plate assembly.
Figure 4:
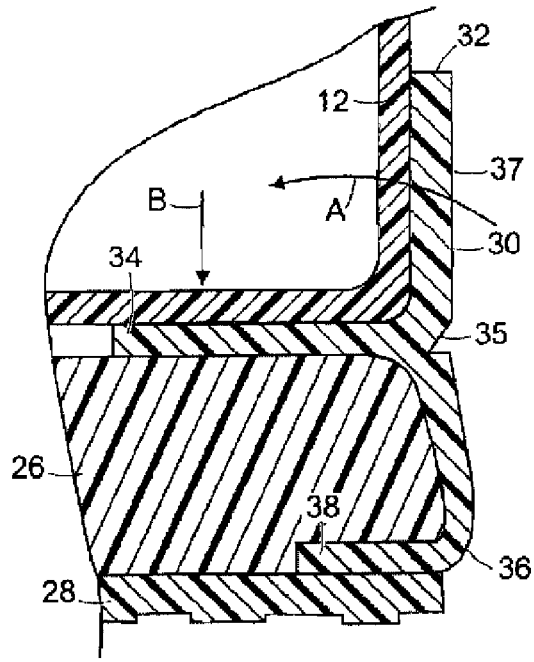
FIG. 4 is a section view of the article of footwear of FIG. 3, taken along line 4-4.

In certain embodiments, as illustrated in FIGS. 3-4, a lower plate 38 extends inwardly from a lower portion of support member 32. Lower plate 38 is positioned between midsole 26 and outsole 38. In the illustrated embodiment, lower plate 38 extends inwardly from a lowermost edge 36 of support member 32. In such embodiments, support member 32 necessarily extends downwardly along midsole 26 such that lowermost edge 36 of support member 32 is proximate the lowermost edge of midsole 26.

It is to be appreciated that in embodiments in which there is no lower plate 38, such as seen in FIGS. 1-2, support member 32 need not extend downwardly as far as the lowermost edge of midsole 26.

It is to be appreciated that support member 32 and lower support member 37 may be of unitary, that is, one-piece construction such that they appear to form a single support member extending along a portion of the exterior of midsole 26 and upper 12.

It is to be appreciated that the amount of support and control can be optimized for particular users, for particular activities, or for any other desired reason. For example, by altering the materials used to form support plate assembly 30, as well as other components of footwear 10, the amount of support and control can be varied. Support plate assembly 30 can be formed of any desired material. Suitable materials include plastics, elastomers, carbon-filled materials, a polyether block copolyamide (sold as Pebax® by ATOFINA Chemicals of Philadelphia, Pa.), a blend of a polyether block copolyamide with another material (such as glass-filled nylon, carbon-filled materials, polyamides, or poly-paraphenylene terephthalamides), thermoplastic polyurethane (TPU), or other materials. Other suitable materials will become readily apparent to those skilled in the art, given the benefit of this disclosure.

As seen in the embodiment shown in FIG. 1, support plate assembly 30 is positioned on medial side 22 of footwear 10, and extends from heel portion 20, through midfoot portion 16, to forefoot portion 16. In the illustrated embodiment, support member 32 of support plate assembly 30 includes two upwardly extending portions 40 separated by a trough 42. It is to be appreciated that support member 32 can have any desired profile.

Figure 5:
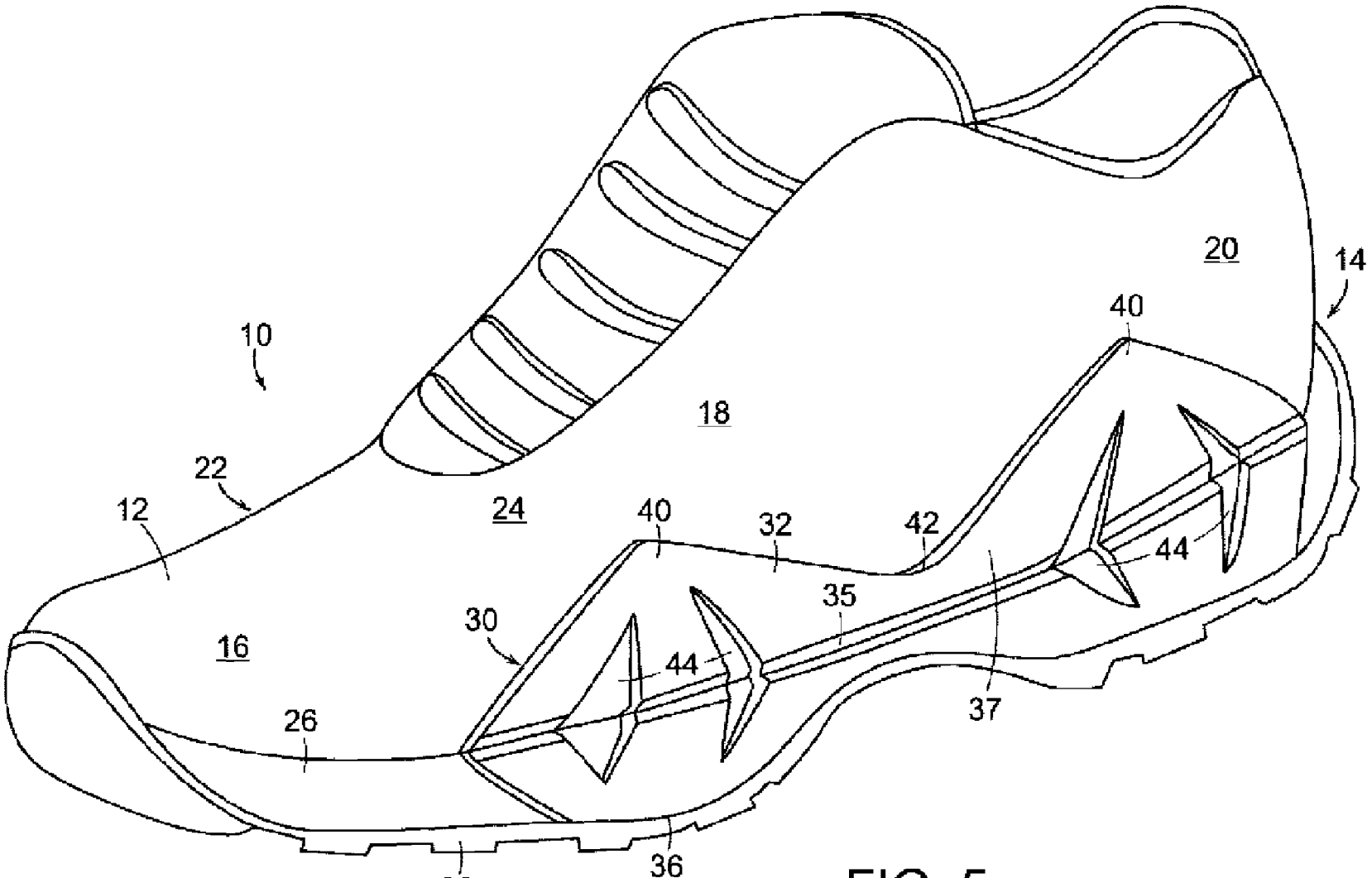
FIG. 5 is a perspective view of another alternative embodiment of an article of footwear with a support plate assembly.

It is to also be appreciated that support plate assembly 30 can be positioned at any desired location along footwear 10. For example, as seen in FIG. 5, support plate assembly 30 can be positioned on lateral side 24 of footwear 10. In this embodiment, support member 32 of support plate assembly 30 includes a pair of vertically extending apertures 44 in each portion 40. Apertures 44 serve to reduce the weight of support member 32 as well as providing improved aesthetics.

In another embodiment, as illustrated in FIG. 6, support plate assembly 30 is positioned between forefoot portion 16 and midfoot portion 18 near the ball of the user's foot on lateral side 24. In this embodiment, support member 32 of support plate assembly 30 includes a plurality of horizontally extending ribs 46 separated from one another by corresponding grooves 48.

It is to be appreciated that more than one support plate assembly 30 may be included in footwear 10. Thus, for example, a support plate assembly 30 such as the one shown in FIG. 6 may be combined with another support plate assembly 30, having any desired configuration, at a different location on lateral side 24, or it could be combined with one or more support plate assemblies, having any desired configuration, on medial side 22.

Another embodiment of support member 32 is illustrated in FIGS. 7-8, in which support member 32 includes a pair of arms 50 that extend upwardly from a base portion 52. Each arm 50 is spaced from the opposed arm by a gap 54 extending through support member 32. Forming support member 32 of a pair of spaced apart arms 50 provides for flexibility and/or bending of support member 32 forwardly and rearwardly. This may be especially advantageous when such a support member is positioned at a location along footwear 10 such as near the ball of the user's foot on either medial side 22 or lateral side 24, for example.

In other embodiments, different components can be used within footwear 10 to impart different control and support characteristics. Thus, for example, midsole 26 may be formed of conventional polymer foams that are utilized in footwear midsoles, including ethylvinylacetate and polyurethane foam. To optimize the performance of footwear 10 in such embodiments, the density of the foam or other material used to make midsole 26 can be varied throughout footwear 10 to provide different levels of support and/or control throughout footwear 10. For example, the rate of pronation can be altered by changing the density of the materials used to form midsole 26. Thus, to increase the rate of pronation, a lower density material can be used, and to decrease the rate of pronation, a higher density material can be used.

To provide decreased resistance in the inner portion of midsole 26, certain embodiments, as shown in FIG. 9, may include a fluid-filled bladder 60 in midsole 26 inward of its outer peripheral portion. To optimize the performance of footwear 10 having a fluid-filled bladder, the pressure within bladder 60 can be varied. Thus, for example, to provide an increased rate of pronation for a support assembly 30 positioned on medial side 22 of footwear 10, a lower pressure would be provided within bladder 60, while a higher pressure within bladder 60 would provide a decreased rate of pronation. Similarly, for a support assembly 30 positioned on lateral side 24 of footwear 10, the rate of supination can be controlled by increasing or decreasing the pressure within bladder 60.

The ability to control the rate of pronation and supination can also be controlled by varying the resistance provided by, or the density of midsole 26. Thus, as illustrated in FIG. 8, an outer portion 62 of midsole 26 may have a first density while an inner portion 64 has a second density. To increase or decrease the rate of pronation/supination, the first density of outer portion 62 and the second density of inner portion 62 can be varied, thereby allowing support member 32 to move inwardly in the direction of arrow A at any desired velocity. The properties of outer portion 62 and inner portion 64 can be varied by forming the respective portions of different materials, for example. Other methods of varying the density, or resistance, of outer portion 62 and inner portion 64 will become readily apparent to those skilled in the art, given the benefit of this disclosure.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising, in combination:

an upper;

a midsole secured to the upper; and a support plate assembly comprising:

a support member having an upper portion extending along a portion of the upper, an exterior surface of the upper portion defining a first plane, and a lower portion extending along a portion of and in direct contact with the midsole, an exterior surface of the lower portion defining a second plane;

a plate extending inwardly from the support member, the plate being positioned between the upper and the midsole; and a groove formed in an exterior surface of the support member, the groove extending inwardly from a surface of both the upper and lower portions of the support member, having a first sidewall defining a third plane and a second sidewall defining a fourth plane, and extending longitudinally along the exterior surface of the support member;

wherein the third plane intersects with the first and fourth planes, and the fourth plane intersects with the second and third planes.

2. The article of footwear of claim 1, wherein the support plate assembly is positioned on a medial side of the upper.

3. The article of footwear of claim 1, wherein the support plate assembly is positioned on a lateral side of the upper.

4. The article of footwear of claim 1, wherein the support plate assembly is positioned on a medial side of the upper, and further comprising a second support plate assembly positioned on a lateral side of the upper.

5. The article of footwear of claim 1, wherein the support plate assembly extends from a forefoot portion of the upper to a heel portion of the upper.

6. The article of footwear of claim 1, wherein the support plate assembly is positioned along a forefoot portion of the upper.

7. The article of footwear of claim 1, wherein the support plate assembly includes a pair of arms that extend upwardly from a base portion and are spaced from one another with a gap formed therebetween.

8. The article of footwear of claim 1, further comprising a lower plate extending inwardly from a lower edge of the lower support member, the lower plate being positioned beneath the midsole.

9. The article of footwear of claim 8, further comprising an outsole secured to the midsole, the lower plate being positioned between the midsole and the outsole.

10. The article of footwear of claim 1, wherein an inner portion of the midsole has a first density and an outer portion of the midsole has a second density, the first density being lower than the second density.

11. The article of footwear of claim 1, wherein the midsole includes a fluid-filled bladder positioned inwardly of a peripheral portion of the midsole.

12. An article of footwear comprising, in combination:

an upper;

a midsole secured to the upper;

an outsole secured to the midsole; and a support plate assembly comprising:

a support member having an upper portion extending along a portion of the upper, an exterior surface of the upper portion defining a first plane, and a lower portion extending along a portion of and in direct contact with the midsole, an exterior surface of the lower portion defining a second plane;

a plate extending inwardly from the support member, the plate being positioned between the upper and the midsole;

a lower plate extending inwardly from support member, the lower plate being positioned between the midsole and the outsole; and a groove formed in an exterior surface of the support member, the groove extending inwardly from a surface of both the upper and lower portions of the support member, having a first sidewall defining a third plane and a second sidewall defining a fourth plane, and extending longitudinally along the exterior surface of the support member;

wherein the third plane intersects with the first and fourth planes, and the fourth plane intersects with the second and third planes.

13. The article of footwear of claim 12, wherein the support plate assembly is positioned on a medial side of the upper.

14. The article of footwear of claim 12, wherein the support plate assembly is positioned on a lateral side of the upper.

15. The article of footwear of claim 12, wherein the support plate assembly is positioned on a medial side of the upper, and further comprising a second support plate assembly positioned on a lateral side of the upper.

16. The article of footwear of claim 12, wherein an inner portion of the midsole has a first density and an outer portion of the midsole has a second density, the first density being lower than the second density.

17. The article of footwear of claim 12, wherein the midsole includes a fluid-filled bladder positioned inwardly of a peripheral portion of the midsole.

* * * * *